US008544775B2

(12) United States Patent
Mancuso

(10) Patent No.: US 8,544,775 B2
(45) Date of Patent: Oct. 1, 2013

(54) PUTRESCIBLE ORGANIC WASTE TREATMENT

(75) Inventor: Noel Mancuso, Taren Point (AU)

(73) Assignee: Pioneer Waste Management Holdings Trust PTY Limited, New South Wales (AU)

( * ) Notice: Subject to any disclaimer, the term of this patent is extended or adjusted under 35 U.S.C. 154(b) by 309 days.

(21) Appl. No.: 12/600,211

(22) PCT Filed: May 15, 2008

(86) PCT No.: PCT/AU2008/000685

§ 371 (c)(1),
(2), (4) Date: Jun. 25, 2010

(87) PCT Pub. No.: WO2008/138069

PCT Pub. Date: Nov. 20, 2008

(65) Prior Publication Data

US 2010/0308143 A1 Dec. 9, 2010

(30) Foreign Application Priority Data

May 15, 2007 (AU) ..... 2007202168

(51) Int. Cl.
*B02C 25/00* (2006.01)

(52) U.S. Cl.
USPC ..... 241/36; 241/46.17

(58) Field of Classification Search
USPC ..... 241/33, 36, 46.17, 46.017
See application file for complete search history.

(56) References Cited

U.S. PATENT DOCUMENTS

| | | | | |
|---|---|---|---|---|
| 2,762,004 | A | 9/1956 | Shepardson | |
| 4,973,002 | A | 11/1990 | Waller et al. | |
| 5,308,000 | A * | 5/1994 | Riley | 241/33 |
| 5,344,085 | A | 9/1994 | Hofseth | |
| 6,032,885 | A | 3/2000 | Ellery | |
| 6,910,648 | B1 | 6/2005 | Reinhold | |
| 7,201,337 | B1 | 4/2007 | Feola | |

FOREIGN PATENT DOCUMENTS

| | | | |
|---|---|---|---|
| CN | 1871069 | | 11/2006 |
| FR | 2 668 953 | A1 | 5/1992 |
| GB | 745978 | A | 3/1956 |
| GB | 1 390 735 | A | 4/1975 |
| JP | 08-1136 | A | 9/1996 |
| JP | 10-137726 | | 5/1998 |
| JP | 2-88535 | | 1/1999 |
| JP | 11-28382 | A | 2/1999 |

(Continued)

OTHER PUBLICATIONS

International Search Report for PCT/AU2008/000685, Aug. 11, 2008.

(Continued)

*Primary Examiner* — Mark Rosenbaum
(74) *Attorney, Agent, or Firm* — King & Spalding

(57) ABSTRACT

A putrescible organic waste treatment system comprising a comminution unit configured to substantially comminute putrescible organic waste into a pulp slurry. The comminution unit is adapted for connection to a supply of water. A controller can control the flow rate and/or volume of water supplied to the comminution unit and control the comminution unit. The controller is responsive to one or more operating parameters of the comminution unit in order to control the quantity of water supplied to the comminution unit to produce a waste pulp having a predetermined physical characteristic.

10 Claims, 2 Drawing Sheets

(56) References Cited

FOREIGN PATENT DOCUMENTS

| | | | |
|---|---|---|---|
| JP | 2000-084431 | | 3/2000 |
| JP | 2000-342989 | | 12/2000 |
| JP | 2001-115518 | | 4/2001 |
| JP | 2001-232228 | | 8/2001 |
| JP | 2001-300472 | | 10/2001 |
| JP | 2002-066526 | | 3/2002 |
| JP | 2003-320267 | | 11/2003 |
| JP | 2006-015231 | | 1/2006 |
| JP | 2006-015250 | | 1/2006 |
| WO | WO 90/10123 | A1 | 9/1990 |
| WO | WO 02/00351 | A1 | 1/2002 |
| WO | WO 2005/039775 | A1 | 5/2005 |

OTHER PUBLICATIONS

Office Action from corresponding Japanese Patent Application 2010-507764, Mar. 7, 2013.

* cited by examiner

PUTRESCIBLE ORGANIC WASTE TREATMENT

CROSS REFERENCE TO RELATED APPLICATIONS

This application is a 35 U.S.C. 371 national phase patent application and claims priority to International Patent Application No. PCT/AU2008/000685, entitled "Putrescible Organic Waste Treatment," and filed May 15, 2008, which claims the benefit of priority to Australia Patent Application No. 2007202168, entitled "Putrescible Organic Waste Treatment," and filed May 15, 2007. The entire contents of each of the above-identified patent applications are hereby incorporated herein by reference.

FIELD OF THE INVENTION

The present invention relates to a putrescible organic waste treatment system and method and to a system and method for producing a feed source for producing biogas fuel.

BACKGROUND OF THE INVENTION

Waste disposal units are used to comminute putrescible organic waste into a slurry or pulp for transport away from the point at which comminution occurs. In domestic situations, the waste disposal unit may be located adjacent to a kitchen sink area where food is prepared.

Larger scale waste disposal units may also be used in industrial applications such as in restaurants, canteens, hotel kitchens, fruit/vegetable shops, food courts, hospitals, fast food outlets, clubs, bakeries and supermarkets, Such units are often used to reduce the waste to a slurry and water is added as a delivery means so as to transport the slurry down a waste line to a waste outlet, for example a sewerage system. The resultant product transported to the waste outlet is substantially a liquid.

After treatment in the waste disposal unit, the waste pulp is usually eliminated by disposal in the sewerage system, thereby increasing the amount of waste that that will require treatment through the sewer system. Furthermore, there is no automated control over the amount of water required to flush the putrescible organic waste during comminution and hence there is a strong possibility that an excess amount of water may be used in the comminution process. This of course leads to wastage of scheme water which is environmentally undesirable and expensive.

A further disadvantage in disposing putrescible organic waste in sewerage systems is that a potential energy source is not utilised. Biological waste can be digested in anaerobic reactors to produce 'biogas'. Biogas is about 60-65% methane and can be used as a fuel source to generate electricity. The residual slurry product may then be further processed for use as a fertilizer. At the time of writing, this technology has been implemented by Biotechnische Abfallverwertung GmbH & Co KG (BTA) in 22 plants worldwide. A problem for biogas producers such as BTA is that the biological waste feed collected for the biogas digester can be contaminated with inorganic materials such as plastics, cardboard and ceramics due to the inadvertent inclusion at the point of collection of the putrescible organic waste material.

Any discussion of documents, publications, acts, devices, substances, articles, materials or the like which is included in the present specification has been done so for the sole purpose so as to provide a contextual basis for the present invention. Any such discussions are not to be understood as admission of subject matter which forms the prior art base, or any part of the common general knowledge of the relevant technical field in relation to the technical field of the present invention to which it extended at the priority date or dates of the present invention.

SUMMARY OF INVENTION

In a first aspect, the present invention provides a putrescible organic waste treatment system. A comminution unit is configured to substantially comminute putrescible organic waste into a pulp slurry. The comminution unit is adapted for connection to a supply of water. A controller can control the flow rate and/or volume of water supplied to the comminution unit and control the comminution unit. The controller is responsive to the load on the comminution unit in order to control the quantity of water supplied to the comminution unit to produce a waste pulp having a predetermined physical characteristic.

In a second aspect the present invention provides a putrescible organic waste treatment system comprising at least one comminution unit, a holding tank, a transport line and an evacuation means. Each comminution unit is adapted to substantially comminute putrescible organic waste into a pulp slurry. The holding tank can hold the pulp from each comminution unit. The transport line connects each comminution unit to the holding tank, whereby the tank and transport line form a closed system. The evacuation means is operable to depressurise the holding tank and thereby create a reduced pressure in the tank and transport line. This facilitates the transport of the pulp slurry from each comminution unit to the holding tank along the transport line.

BRIEF DESCRIPTION OF THE DRAWINGS

A preferred exemplary embodiment of the invention will now be described by way of example only with reference to the accompanying drawings in which.

DETAILED DESCRIPTION OF THE EMBODIMENTS

Figure 1:
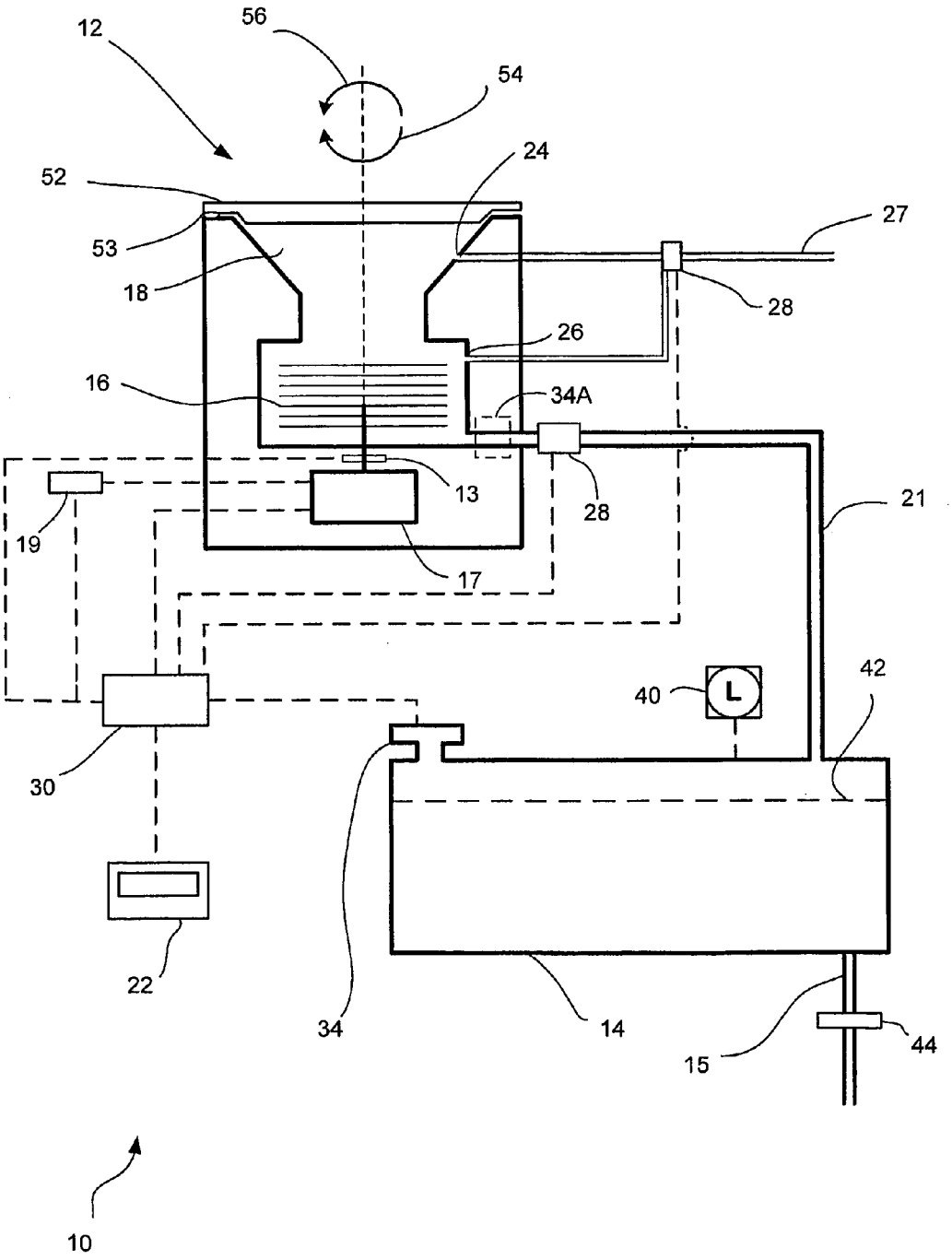
FIG. 1 shows a schematic diagram of a putrescible organic waste treatment system according to an embodiment of the invention.

The following description refers to preferred embodiments of the putrescible organic waste treatment system, treatment method, and method and system for producing a biogas fuel according to the present invention. To facilitate an understanding of the invention, reference is made in the description to the accompanying drawings whereby the present invention is illustrated in a preferred embodiment. Similar components between the embodiments are identified by the same reference numerals.

FIG. 1 shows a schematic diagram of an embodiment of the invention in which there is shown a putrescible organic waste treatment system 10 that includes a comminution unit 12 having an outlet 20 that is in fluid communication with a receptacle in the form of a holding tank 14. The comminution unit 12 includes an internal chamber 18 which is used to receive putrescible organic waste. The internal chamber 18 is located above the grinding unit 16 which is used to comminute and masticate the putrescible organic waste. The system 10 also includes a control panel 22 that is used to control the comminution unit 12.

The comminution unit 12 includes comminution means in the form of a grinding unit 16 which is operable by a motor 17 to comminute putrescible organic waste into a pulp or slurry during a comminution operation. The comminution unit also includes a mechanical brake 11 for stopping the grinding unit 16. The brake 11 is in communication with a control unit in the form of a programmable logic controller (PLC) 30. It will be appreciated that in alternative embodiments, other comminution units may also be used, for example cutting blades, and the motor 17 may be either internal or external to the comminution unit 12, and the brake 11 need not be provided.

A water supply 27 is also connected to the comminution unit 12 and is controlled by the PLC 30. Water from the water supply 27 is introduced into the comminution unit 12 at the internal chamber 18 by water jet 24 and at the grinding unit 16 by water jet 26.

If required additional water inlet jets may be provided in the comminution unit 12. For example, if a pump is used to pump the waste pulp from the comminution unit 12 to the holding tank 14 (as opposed to the vacuum arrangement described below) an additional water inlet may be placed between the grinding unit 16 and the pump to prime the pump before use.

The PLC 30 is programmed to receive information regarding the operating parameters of the comminution means from the comminution means, and on the basis of that information control the grinding unit 16 and the water supplied to the comminution unit during comminution of the putrescible organic waste.

For example, the motor 17 may be fitted with a load sensor 19 for sensing the load on the motor 17 driving the comminution means. For relatively soft waste, such as vegetable matter, the load sensor 19 will read only a low load and the PLC 30PLC 30 will not supply a large amount of water. In contrast, for harder waste such as bones and/or seeds etc, the load sensor 19 will read a high load and the PLC 30PLC 30 will supply a greater amount of water to aid in the comminution and transport of comminuted waste from the unit 16. Additionally, when a suitably small load is detected on the grinding unit 16 the controller 30 can interpret this to be that there is no more material requiring comminution and switch the grinding unit 16 off.

Finally, if the load on the motor 17 is sensed to exceed a predetermined value, or to exceed a predetermined value for a predetermined time, the PLC 30 can be programmed to interpret this as an indication that the grinding unit 16 has become stuck and should either be shut off or the direction of rotation changed (as discussed below) in order to prevent damage to the grinding unit 16 or the motor 17.

When the PLC 30 cuts power to the grinding unit 16 (for example at the end of a cycle or in the event of a blockage/jam or some other fault) the PLC 30 also operates the brake 11 in order to halt the rotation of the grinding unit. Although without power the grinding unit 16 would, of course, eventually stop turning of its own accord (and therefore a brake 11 is not strictly necessary) by providing a brake 11 the grinding unit 16 will come to a halt in a shorter period of time, allowing for stoppage time (either due to a malfunction or merely time between cycles) to be minimised. Instead, or in addition, dynamic braking may be used to more rapidly halt the rotation of the grinding unit. A simple dynamic braking arrangement may involve the PLC 30 switching in a dynamic braking resistor (not shown) across the armature terminals of the motor 17 when the PLC 30 cuts power to the grinding unit, transforming the motor 17 into a generator.

By supplying water according to the load of the comminution means the PLC 30 can automatically determine and add the appropriate amount of water to ensure that any one or more of the following pulp characteristics are produced by the comminution unit:

- a defined pulp density;
- range of pulp densities;
- a defined moisture content; or a range of moisture contents, flow characteristic or range of flow characteristics.

The density, moisture content and flow characteristics may be selected to ensure the most efficient transportation of the pulp waste material, or selected to optimise the pulp waste material for further use. For example, the further use of the pulp waste material may be transportation to a biogas plant for use in a digester for the production of biogas.

The PLC 30 can be programmed to introduce a predetermined volume of water during each comminution cycle. An appropriate volume of water per cycle may be between 2 to 5 liters, this volume divided between the water jets 24 and 26. Alternatively, the PLC 30 can be programmed to vary the amount of water supplied according to the load on the motor 17.

Water jets 24 and 26 are fed by a mains water line 27 which includes an on/off control valve 28. The on/off control valve 28 is used to allow water to flow to the jet 24 in use. The outlet 20 of the comminution unit 12 is connected to the holding tank 14 via outlet line 21.

In the preferred embodiment of the invention, holding tank 14 is fitted with a vacuum pump 34 for depressurising the holding tank 14. In this embodiment waste from the comminution unit is transferred through the pipes by the suction created in the sealed holding tank 14. The vacuum pump 34 is operable to create a negative pressure in the system of, for example, up to −25 inches of mercury. In order to create and maintain this pressure the level indicator 40 in the holding tank 14 can be configured to register the holding tank 14 as full while there is still 250 liters of empty space in the holding tank 14. Typically, each unit 12 will deliver approximately 25 liters of fluid in each cycle to the holding tank 14. The vacuum system will be designed to accommodate the discharge of fluid from the (or each) unit along the backbone outlet line to the holding tank 14. Clearly, for different unit arrangements and apparatus different evacuation systems, holding tanks, delivery pipes and the like will be required in order to have the capacity to transport the expected liquid, solid and air mixture to the holding tank.

This arrangement is particularly suitable where a number of independent comminution units are in operation (for example an apartment building or a food hall) and all units feed into a single common holding tank 14. The units may all be connected to the holding tank through a single backbone outlet line. Alternatively, each unit may be connected to the holding tank 14 by an individual outlet line. The PLC 30 is connected to the vacuum pump to cause the vacuum pump to operate when the comminution unit is operating. Alternatively, the vacuum pump can be adapted to operate on a pressure switch system.

To prevent inadvertent loss of suction in this embodiment, a sealing valve 35 is provided between the comminution unit 12 and transport line 21. Valve 35 is connected to PLC 30 which operates the valve between an open and closed state. In the closed state air flow from the comminution unit 12 into the outlet line 21 is substantially prevented thus maintaining pressure in the system 10. At the appropriate time (for example the beginning of a comminution cycle) the PLC 30 causes the sealing valve 35 open so that the pulp is sucked down the transport line 21 into the holding tank 14. Alternate arrangements for transportation of the waste pulp through the system are, of course, possible. For example, instead of fitting the holding tank with a vacuum pump 34 to create a vacuum for waste transportation, a standard pump may be installed to pump the waste from the comminution unit 12 to the tank 14. An appropriate placement for such a pump is indicated by reference numeral 34A. As noted above, if a standard pump is to be used to pump waste through the system an additional water outlet (not shown) can also be provided in order to prime the pump. The additional water outlet would advantageously be connected to the mains supply 27 through valve 28 and be located between the grinding unit 16 and location of the pump 34A.

The holding tank 14 is also connected to an outlet pipe 15 which includes a valve 44 as shown in the diagram. Preferably the valve 44 is manually operable to enable an operator to empty the holding tank 14 independently of the comminution unit 12 and PLC 30. As discussed below, the holding tank 14 also includes a level sensor 40 which is used to sense the level 42 of the pulp in the holding tank 14 at any given time.

The PLC 30 is able to actuate the valve 28 to supply water to the comminution unit 12 as will be described below. The PLC 30 is also connected to the control panel 22 of the system 10.

The system as described above, with the exception of the holding tank 14, may be incorporated within a single unit so as to be conveniently located adjacent a food preparation or processing area, for example in a kitchen or a food processing plant. Such a unit may be appropriately sized, for example to a size similar to that of a domestic clothes washing machine, and the control panel 22 may optionally be integrally formed with the unit. Alternatively, the control panel 22 may be positioned adjacent the unit. Suitable materials from which the unit and various components within the unit are formed include stainless steel for example, thus allowing ease of cleaning and decontamination, if necessary. In another embodiment of the invention, the holding tank 14 may be integrally formed within the unit for particular applications, and be removable such that it may be conveniently emptied.

The comminution unit 12 further includes a lid 52 which pivots about pivot joint 53 and is used to cover the chamber 18 when the comminution unit is in operation. The lid is designed to be lifted by an electronic actuator (not shown) which is also linked to PLC 30. As a safety measure, the PLC 30 is programmed not to allow the comminution means to operate when the lid is open.

In use, the upper part 18 of the chamber is provided with sloping walls so as to funnel the putrescible organic waste material onto the grinding unit 16. The water jet 24 (which may be one of multiple jets placed around the periphery of the upper part 18 of the chamber) is directed onto the surface of the funnel to produce centrifugal flow of water and thereby ensure that all waste material is substantially funnelled onto grinding unit 16. The grinding unit 16 comminutes and masticates the putrescible organic waste material in the presence of the water to produce a putrescible organic waste pulp.

The controller 30 is also configured to store a log of data concerning the comminution unit 12 and holding tank 14 and to communicate this information with a central server. The controller 30 may be programmed to upload this operational data at regular intervals, for example once a day, and may communicate with the server (again by way of example only) over a dedicated wired or wireless internet connection or by a dial up modem.

The data may include, for example:

- the number and type of comminution cycles performed by the comminution unit 12
- the total time which the comminution unit 12 has been operated for
- the load information as sensed by the load sensor 19
- the control operations (as described below) selected by a user of the machine
- the configuration of the controller 30 (such as communication settings, grinding unit 16 settings, door 52 settings)
- the volume of water used during the comminution cycles
- how the capacity of the holding tank 14 has changed with each comminution cycle
- the present capacity of the holding tank 14
- any machine faults This data, both operational and statistical, may be used to determine, for example, if and when upcoming maintenance of the various components (such as the motor 17 or grinding unit 16) of the comminution unit 12 may be required, when the holding tank 14 will require emptying, and general statistical information such as the efficiency of the comminution unit 12 with respect to water usage.

Figure 2:
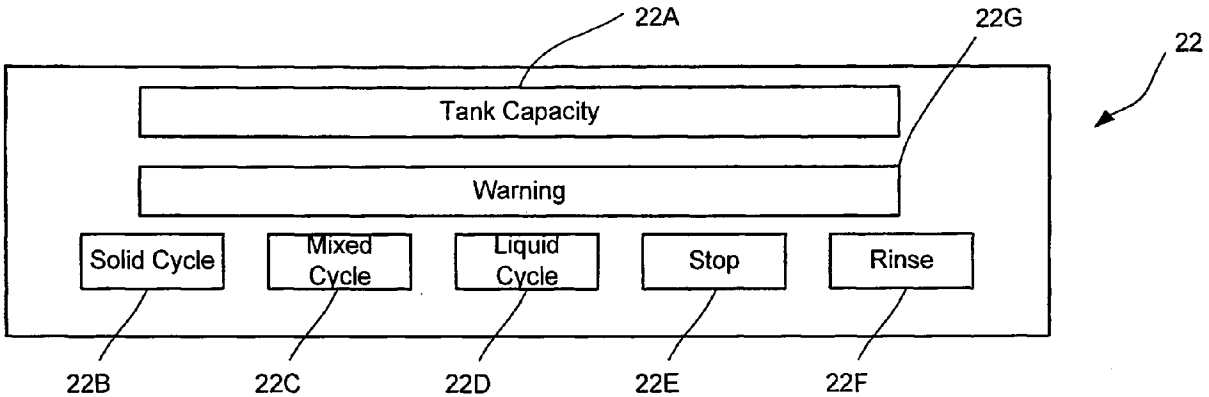
FIG. 2 shows a control panel that may be used in the embodiment depicted in FIG. 1.

Referring to FIG. 2, there is shown a more detailed diagram of the control panel 22 of FIG. 1. The control panel 22 includes:

- a level display 22A, which displays the level of the holding tank 14;
- a warning display 22G, which displays a warning message where, for example, a malfunction such as a blockage or jam is detected in the comminution unit 12;
- a solid cycle button 22B, which inputs to the PLC 30 that the waste placed in the chamber 18 is generally solid in nature;
- a mixed cycle button 22C, which inputs to the PLC 30 that the waste placed in the chamber 18 is a mixture of solids and liquids;
- a liquid button 22D which inputs to the PLC 30 that the waste placed in the chamber 18 is liquid;
- a stop button 22E, which terminates the comminution unit 12; and
- a rinse button 22F, which initiates a rinse cycle to rinse the comminution unit 12 and pipe work as will be described further below.

Although in this example a user can manually operate the system via the control options 22B to 22F, it should be understood that the system may be fully or partly automated and a variety of sensors and controllers maybe implemented within the system to at least partially control the various components of the system without departing from the scope of the invention. For example, the control panel may be restricted to allowing a user to start a comminution cycle or rinse cycle only. In this case, when a user selects the comminution cycle the controller 30 can determine the appropriate amount of water to be added and the time for which the grinding unit 16 should be operated based upon the sensed load of the grinding unit 16 (as described above).

Again referring to FIG. 1, a comminution process is described in accordance with an embodiment of the invention. The lid 52 is raised by an operator of the comminution unit 12, or automatically by implantation of the actuator means. Putrescible organic waste is loaded in the chamber 18. The lid 52 is closed and the operator, using the control panel 22, initiates the operation of the comminution unit 12. and a signal is sent to the PLC 30 which initiates the comminution cycle. The PLC 30 actuates the valve 28 so that a jet of water is supplied to the chamber 18 and (if required) the grinding unit 16.

The jet 28 is located at a position on the cone to cause the fluid to travel centrifugally to ensure that the waste material is swept off the internal chamber 18 walls. The opening of the internal chamber 18 leads onto the grinding unit 16 allowing the grinding unit 16 pulp the material to a predefined size. The valve 28 is actuated for a period of time set by the PLC 30 utilising information received from the load sensor 19 to supply a volume of water to water jets 24, 26 so that an optimal waste pulp will be produced. The operation of the grinding unit 16 itself is also controlled by the controller 30 on the basis of the sensed load on the motor 17.

The optimal pulp density is determined to ensure that the pulp is optimal for transportation to and from the holding tank 14. Valve 28 is a variable valve and is able to vary the flow of water from between 0% to 100% of the total available water flow, depending on the desired flow characteristics and pulp density required.

The PLC 30 is also programmed to alternate the direction in which the grinding unit 16 rotates. The direction of rotation of the grinding unit 16 may, for example, be alternated on each successive use of the unit. For example, on the first use of the unit the PLC will control the grinding unit 16 to rotate in a clockwise direction as shown by arrow 54, on the second use an anti clockwise direction as shown by arrow 56, on the third use a clockwise direction and so on. This is particularly advantageous as each time the grinding unit 16 is started and residual pulp or material is dislodged from the grinding unit 16 rather than being potentially jammed and damaging the grinding unit 16.

Alternatively, the PLC 30 may be programmed to alternate the direction of rotation of the grinding unit 16 if the load on the motor 16 exceeds a predetermined value, or exceeds a predetermined value for a predetermined period of time. In this case the PLC 30 interprets the sensed load as an indicator that the grinding unit 16 is stuck, and by alternating the direction of rotation the grinding unit 16 may be released.

In order to transport the waste pulp the PLC also activates the pump 34 to depressurise the holding tank 14 and transport the waste pulp to the holding tank 14.

In the case where the waste for a particular cycle is comprised essentially of a liquid or has liquid components, for example such as oils, gravies, juices, sauces and the like, the system 10 may be optionally operated without the comminution means 16 being operated, whilst the waste is delivered to the holding tank 14. Such liquids provide high energy feedstock for digestion by a biodigestor. It will be appreciated that although such liquids may be introduced into the system and be added to a pulp already contained within the holding tank 14, the predetermined water content or density is still maintained by the addition of water, or alternatively by decanting excess water should there be an excess.

Once the holding tank 14 is filled with pulp fluid at optimal or predetermined density, the contents of the holding tank 14 can be periodically removed by transportation such as by waste transportation truck. The outlet to the holding tank 14 includes a valve 44, which is an on/off valve, which may be manually operatable.

In one preferred embodiment, the waste pulp is transported to a biogas production plant which utilises the waste pulp as production feed for the production of a biogas.

In the preferred embodiment, the holding tank 14 also includes a level sensor 40, which senses the level 42 of the holding tank 14. This level sensor 40 may, for example, be a sonar arrangement and is arranged to send a signal to the PLC 30 which then displays a level of the tank on the control panel 22. This allows a user of the system to remotely determine when the level of the tank 42 is approaching full. When the waste in the holding tank 14 reaches a predetermined level the controller 30 is programmed to display to the user that only a set number of comminution cycles will be allowed and that the tank must be emptied. Once the set number of cycles have been performed (or in the event that the total capacity of the tank 14 is reached) the controller 30 will prevent operation of the comminution unit 12 until the tank has been emptied. As a safety mechanism the controller 30 will also prevent operation of the comminution unit 12 if no signal is received from the level sensor 40.

As an additional safety mechanism the holding tank 14 may also include a float switch which, when the holding tank 14 is full, communicates with PLC 30 and prevents any operation of the comminution unit the tank 14 has been emptied.

Figure 3:
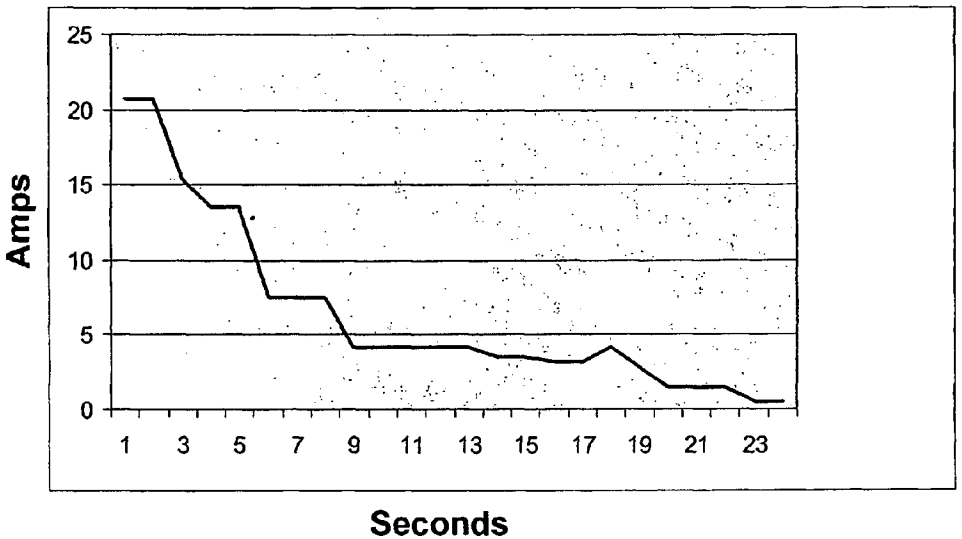
FIG. 3 shows a graph of the current as read by the load sensor against time during a comminution cycle.

FIG. 3 provides a graph of the current (as read by the load sensor 19) of the motor 17 during a comminution cycle. As can be seen the current peaks at time=1 second (the beginning of the comminution process) and gradually decreases over time as the waste is passed through the grinding means 17 and comminuted. At the time of 23 seconds the current of the motor 17 reads approximately 1 Ampere which is interpreted by the controller 30 to mean that there is no further waste requiring comminution and that the grinding unit 16 should be switched off. As discussed above, the controller 30 may be programmed to add a predetermined volume of water to the comminution unit 12 during each comminution cycle regardless of the load sensed by the load sensor 19.

Alternatively, the controller 30 may be programmed to vary the amount of water added according to the load on the motor 17.

It will be appreciated that the system 10 can be automated to output and subsequently store in the holding tank waste pulp of a desired density. This ensures that an excess or insufficient amount of water is used to produce the waste pulp for storage in holding tank 14. The optimal waste pulp density should be such that a minimal amount of water is included in the pulp to ensure comminution and transport through pipe work 20, 21, 15. This ensures that the holding tank 14 is able to store the maximum amount of putrescible organic waste for the capacity of the tank. This ensures that collection of putrescible organic waste from the holding tank 14 is minimised, thereby advantageously optimising the transportation process.

A further advantage of the present system 10 is that it prevents putrescible organic waste from being disposed of through the sewerage system, hence reducing loads on the sewerage system and the environment.

Clearly the density of the waste contained in the waste tank can be varied as required, either by adding water to the waste, or allowing the waste to settle and excess water to decant from the holding tank 14. This may be achieve by either allowing the excess water to pass through appropriate filters or baffles, so that the water leaving the tank is sufficiently clear to pass directly into the municipal sewerage system without requiring further treatment, or having some form of simple pre-treatment tank through which the water will pass before passing into either a sewerage system, or other treatment arrangement. Optionally the system can have a density control sensor located in the tank to evaluate whether water needs to be added to or removed from the tank in order to achieve the preferred density/flowability characteristics, thereby ensuring that the waste removal vehicle and system operates at optimum efficiency.

It will be further appreciated that as the system utilises a filter 33, inorganic materials such as plastic can be substantially prevented from entering the holding tank 14.

A further advantage of the invention is that as the pulp material is substantially organic, it can be used as a feed source in the production of biogas in a digester. Accordingly, the present invention allows more efficient and better control of collection of putrescible organic waste at the disposal point.

It will be appreciated that a number of systems according to the invention may be incorporated, for example in a high-rise unit block or food court, and then piped to a single holding tank for ease of collection from one source. Typically, this arrangement will work best when transport of material is achieved via a vacuum transport line leading to a tank which is evacuated using a pressure switched vacuum pump.

It will also be appreciated that putrescible food waste, when dumped in conventional dumpsters, is often mixed with other non-degradable refuse and becomes useless for further processing due to the other non-degradable waste being present. Also, prior to the dumpster being emptied, the waste at least partially decomposes, causing discomfort and potentially health risk issues. Waste from such dumpsters is dumped at dumping sites and the food waste further degrades and decomposes, and emits methane gas, a gas identified as a partial cause of global warming. The present invention allows energy to be generated from such putrescible waste via a biogas digester, rather than the gas being allowed to heat the atmosphere prior to being burnt. A further environmental advantage is also given by the immediate absence of polymeric bags in which such putrescible waste is stored and dumped in, at a waste dumping site. Furthermore, the undesirable odour of decomposing food waste at conventional waste dumping sites is reduced by processing of such waste in accordance with the present invention.

It will be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art can be made thereto, without departing from the scope of the present invention.

The invention claimed is:

1. A putrescible organic waste treatment system comprising:

a comminution unit configured to substantially comminute putrescible organic waste into a pulp slurry, the comminution unit comprising:

a rotary comminution unit driven by a motor and configured to comminute the putrescible organic waste into a waste pulp;

a variable valve configured to control the flow of water from a supply of water to the comminution unit;

a control unit configured to control the variable valve and the motor, wherein responsive to receiving a measure of an electric load on the motor, the control unit is configured to:

control the quantity of water supplied to the comminution unit to produce the waste pulp having a predetermined physical characteristic by controlling the variable valve to vary the flow of water from between 0% and 100% of a total available water flow, and automatically switch the motor off if the measure of the electrical load falls below a predetermined lower threshold.

2. A putrescible organic waste treatment system according to claim 1 wherein the quantity of water supplied to the comminution unit is proportional to the electrical load on the motor.

3. A putrescible organic waste treatment system according to claim 1, wherein the electrical load on the comminution unit is sensed by a load sensor coupled to the motor.

4. A putrescibles organic waste treatment system according to claim 1, further comprising a brake operable by the control unit to brake the comminution unit.

5. A putrescible organic waste treatment system according to claim 4 wherein the brake comprises a dynamic braking resistor.

6. A putrescible organic waste treatment system according to claim 1 wherein:

the control unit is adapted to alternate a direction of rotation of the rotary comminution unit.

7. A putrescible organic waste treatment system according to claim 6, wherein the control unit is adapted to alternate the direction of rotation of the rotary comminution unit for each successive operation cycle of the comminution unit.

8. A putrescible organic waste treatment system according to claim 6, wherein the control unit is adapted to alternate the direction of rotation of the rotary comminution unit if the electrical load on the motor as sensed by the load sensor exceeds a predetermined level.

9. A putrescible organic waste treatment system according to claim 1, wherein the predetermined lower threshold is 1 Ampere.

10. A putrescible organic waste treatment system according to claim 1, wherein the control unit is responsive to the electrical load on the motor in order to automatically switch the motor off if the electrical load on the motor exceeds a predetermined upper threshold.

* * * * *